US005234214A

United States Patent [19]

Sexton et al.

[11] Patent Number: 5,234,214

[45] Date of Patent: Aug. 10, 1993

[54] TENNIS BALL POUCH AND HOLDER

[76] Inventors: Layon A. Sexton, 3596 Limber Lost Trail, Stockbridge, Ga. 30281; John J. Campbell, 2070 Lyda La., Loganville, Ga. 30249

[21] Appl. No.: 925,798

[22] Filed: Aug. 4, 1992

[51] Int. Cl.[5] ..... A63B 61/00

[52] U.S. Cl. ..... 273/29 R; 273/DIG. 30; 2/93; 224/918; 224/919

[58] Field of Search ..... 273/29 R, 29 A, DIG. 30, 273/14, 26 C, 58 K; 224/269, 918, 919; 2/93, 95, 96, 100, 101, 116, 128, 121, 141 R

[56] References Cited

U.S. PATENT DOCUMENTS

| | | | |
|---|---|---|---|
| 3,320,620 | 5/1967 | Weidler et al. | 224/919 |
| 4,079,871 | 3/1978 | Sica | 224/919 |
| 4,294,386 | 10/1981 | Ingram | 224/919 |
| 4,667,344 | 5/1987 | Cooper, III | 2/93 |
| 4,893,739 | 1/1990 | Conner | 224/919 |
| 4,959,876 | 10/1990 | Kalaan et al. | 2/93 |
| 5,056,786 | 10/1991 | Belletini | 273/DIG. 30 |
| 5,139,273 | 8/1992 | Rudell et al. | 273/DIG. 30 |

*Primary Examiner*—Theatrice Brown

[57] ABSTRACT

The invention relates to a tennis ball holder and storage apparatus incorporated with a garment to be worn by a tennis player. The garment is previded with a hook element and a loop element of a hook and loop connector. The hook element is attached to the garment along a pocket open end and the loop element is attached to a pocket flap which exteds over the pocket opening such that the hook and loop elements will be aligned and engaged. The hook element on the garment can further be engaged with the nap surface on a standard tennis ball to thereby attach the ball to the garment. A pouch having a loop portion of a hook and loop fastener attached along its upper edge and adjacent its opening is provided. The loop portion on the pouch can be engaged with the hook element on the garment to thereby provide the garment with an auxiliary pocket for holding tennis balls.

1 Claim, 1 Drawing Sheet

TENNIS BALL POUCH AND HOLDER

BACKGROUND OF THE INVENTION

The present invention relates to a simple method of holding a Tennis Ball in close proximity to the player during the normal course of play. A need exists for Tennis Balls to be easily accessed during periods of play, especially second service, without having to retrieve them from the ground or from pockets not designed specifically to accommodate Tennis Balls. It is also important that comfort of the player not be adversely affected. Finally, the ball should be held in a location so as not to restrict normal movement of the player.

SUMMARY OF THE INVENTION

The present invention is a system comprised of a Garment Pocket with Hook and Loop fasteners to which the covering on a Tennis Ball will adhere to the Hook material when the flap comprising the Loop material is tucked inside the pocket. As the covering on the Tennis Ball becomes worn, a pouch comprising the Loop material is affixed to the Hook material to provide an alternative method of storing and accessing the Tennis Balls.

DESCRIPTION OF THE PREFERRED EMBODIMENT

Figure 1:
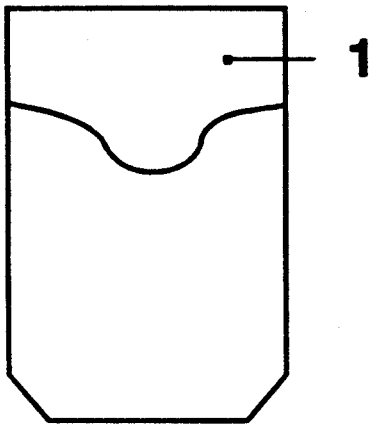
FIG. 1 An external view of Garment Pocket with flap closed.

The Garment Pocket is FIG. 1 is used as a Tennis Ball holding system. The Hook fastener in FIG. 5 which is attached to FIG. 1 makes up one half of the Tennis Ball holding system. The covering of the Tennis Ball is affixed to the Hook material strip in FIG. 6. A separate Tennis Ball Pouch in FIG. 4 is affixed to the Hook material strip in FIG. 1 constituting the remainder of the Tennis Ball holding system. Tennis Balls are then stored in the Pouch as shown in FIG. 3.

FIG. 1. Illustrates the Garment Pocket, FIG. 1, with the flap closed. The flap is kept closed with Hook, FIG. 5, and Loop, FIG. 6, strips.

Figure 2:
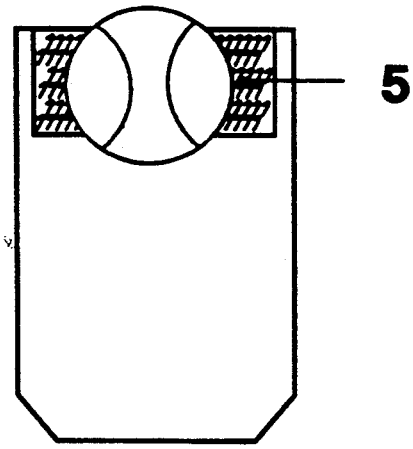
FIG. 2 An external view of Garment Pocket with flap tucked inside and Tennis Ball affixed to Hook fastener strip.

FIG. 2. Illustrates the Garment Pocket, FIG. 1, with the flap tucked inside. The Hook, FIG. 5, fastener strip will hold a Tennis Ball suspended on the outside of the Garment.

Figure 3:
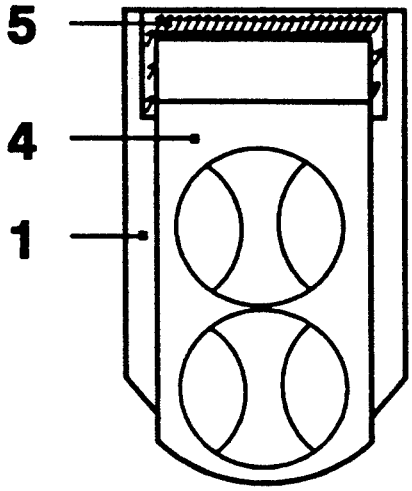
FIG. 3 An external view of Garment Pocket with flap tucked inside and Pouch affixed to Hook fastener strip.
Figure 4:
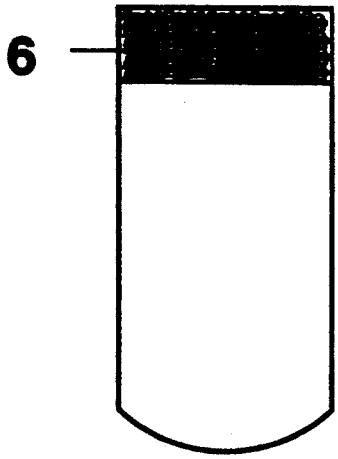
FIG. 4 A view of separate Tennis Ball Pouch.

FIG. 3. Shows the Garment Pocket, FIG. 1, with the flap tucked inside and a separate Ball Pouch, FIG. 4, attached. The Garment Pocket, FIG. 1, has a Loop, FIG. 6, fastener strip attached and is held onto the Garment by attaching to the Hook, FIG. 5, fastener strip which is exposed when the Pocket Flap is tucked inside. The Pouch will hold up to three Tennis Balls.

FIG. 4. Shows the separate Pouch from the back with the attached Loop, FIG. 6, fastener strip visible. This Pouch can be attached to a variety of Garments.

Figure 5:
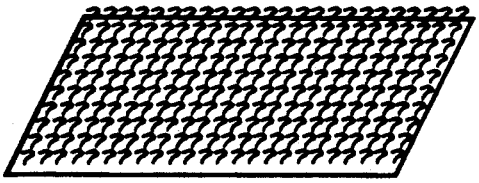
FIG. 5 Sample of Hook fastener system.

FIG. 5. Shows sample of Hook fastener system.

Figure 6:
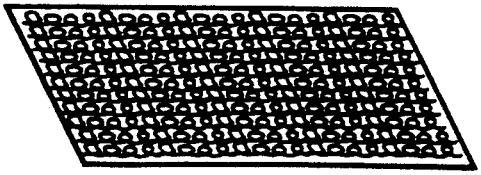
FIG. 6 Sample of Loop fastener system.

FIG. 6. Shows sample of Loop fastener system.

We claim:

1. A tennis ball holder in combination with a standard tennis ball comprising;

a garment to be worn by a tennis player, said garment having at least one pocket having an open upper end and a closed lower end; flap means having a first portion attached to said garment above said upper end and a second portion overlapping said pocket upper end and extending a predetermined distance along an outer surface of said garment pocked to define a closure for said pocket open end; said flap second portion further being a size to extend into said open upper end;

hook and loop elements defining means to fasten said closure over said pocket upper end, said hook element being attached to said garment to be overlapped by said flap means, and said loop element being attached to said flap means such that when said flap means is extended said predetermined distance said hook and loop elements will be engaged to hold said flap means in a stationary position;

at least one standard tennis ball; said ball having a nap material covering a predetermined portion of its outer surface, said nap material, when engaged with said hook element, will cause said ball to adhere to said garment when said second portion of said flap is positioned in said open upper end;

a tennis ball storage means, said storage means defining an auxiliary pocket having an open end and a closed end, and being of a size to allow said at least one tennis ball to be stored therein; and, loop fastener means attached to said auxiliary pocket along said upper end, said loop fastening means being engagable with said hook element for attaching said auxiliary pocket to said garment when said at least ball is not attached to said hook element.

* * * * *